US005725742A

United States Patent [19]

Grimmeiss et al.

[11] Patent Number: 5,725,742

[45] Date of Patent: Mar. 10, 1998

[54] DEVICE FOR ELECTROLYTIC OXIDATION OF SILICON WAFERS

[75] Inventors: Hermann Georg Grimmeiss; Anders Christer Lindbladh, both of Lund; Carl-Fredrik Anton Mandenius, Huddinge; Mats Otto Persson, Löddeköpinge, all of Sweden

[73] Assignee: Daimler-Benz AG, Stuttgart, Germany

[21] Appl. No.: 522,406

[22] PCT Filed: Mar. 17, 1994

[86] PCT No.: PCT/SE94/00237

§ 371 Date: Nov. 13, 1995

§ 102(e) Date: Nov. 13, 1995

[87] PCT Pub. No.: WO94/21845

PCT Pub. Date: Sep. 29, 1994

[30] Foreign Application Priority Data

Mar. 17, 1993 [SE] Sweden ..... 9300881

[51] Int. Cl.[6] ..... C25D 17/00; C25D 17/06

[52] U.S. Cl. ..... 204/224 R; 204/268

[58] Field of Search ..... 204/224 R, 224 M, 204/268

[56] References Cited

U.S. PATENT DOCUMENTS

| | | | |
|---|---|---|---|
| 3,324,015 | 6/1967 | Saia et al. . | |
| 3,419,480 | 12/1968 | Schmidt . | |
| 4,043,894 | 8/1977 | Gibbs | 204/268 X |
| 4,288,309 | 9/1981 | Cohen | 204/268 X |
| 5,228,966 | 7/1993 | Murata | 204/224 R |
| 5,429,733 | 7/1995 | Ishida | 204/224 R |
| 5,437,777 | 8/1995 | Kishi | 204/224 R |
| 5,458,755 | 10/1995 | Fujiyama et al. | 204/224 R |

FOREIGN PATENT DOCUMENTS 1 496 883 8/1969 Germany .

*Primary Examiner*—Donald R. Valentine

*Attorney, Agent, or Firm*—Stephen C. Glazier

[57] ABSTRACT

A device for electrolytic oxidation of silicon wafers comprises a plate-like anode (6) and a plate-like cathode (1) as well as an arrangement for holding a silicon wafer (4) between and spaced from the anode and the cathode. The anode, the cathode and the silicon wafer are horizontally arranged, and the anode and the cathode are larger than the silicon wafer. The holder arrangement consists of loose spacers (3, 5) which are provided between the silicon wafer and the respective electrode, and which enclose electrolyte, and the stack of electrodes, silicon wafer and spacers being held together only by gravity.

3 Claims, 3 Drawing Sheets

DEVICE FOR ELECTROLYTIC OXIDATION OF SILICON WAFERS

This invention relates to a device for electrolytic oxidation of silicon wafers to be used as semiconductor components or integrated circuits.

The invention sets out from DE-A-1,496,883 and U.S. Pat. No. 3,419,480.

These publications describe electrolytic compartments which are separated by a wall, part of which is a silicon wafer, and which contain relatively small electrodes for producing a silicon oxide layer on one side of the silicon wafer (or on both sides thereof).

The problem to be solved by the invention resides in that the silicon oxide layers of the prior art do not have uniform thickness. This entails non-uniform electrical properties of the resulting oxidised silicon wafer, the semiconductor component or the integrated circuit.

The inventive concept aims to alleviate this problem. This has been achieved as recited in the appended claims.

According to the invention, the electrodes and the silicon wafer are horizontally arranged, resting on each other by the intermediary of spacers, and the electrodes are larger than the silicon wafer.

It is believed that the favourable effect of this design on the uniformity of the silicon oxide layer derives from the uniform electric field which is achieved by the gravity-warranted horizontal positioning and by the larger electrodes. Advantageously, the electrolyte is a buffer solution yielding substantially constant reaction kinetics, but it may also be of another type, e.g. weak HCl.

In practice, the invention ensures that the oxidation of silicon wafers, with resultant uniform silicon oxide layers, is made independent of the size of the silicon wafer.

By "uniform" silicon oxide thickness is here meant a silicon oxide thickness which at any rate is more uniform across the treated surface of the silicon wafer as compared with what is achievable by means of the small electrodes and larger silicon wafer of the prior art. Preferably, the uniformity of the oxide layer thickness is ±5 Å in the thickness range of 200–2000 Å of the silicon wafer, this range being at present technically acceptable for so-called high-integration circuits. In preferred embodiments of the invention, the above-mentioned ranges are determined by parameters recited in the appended claims and in the Examples below.

Figure 1:
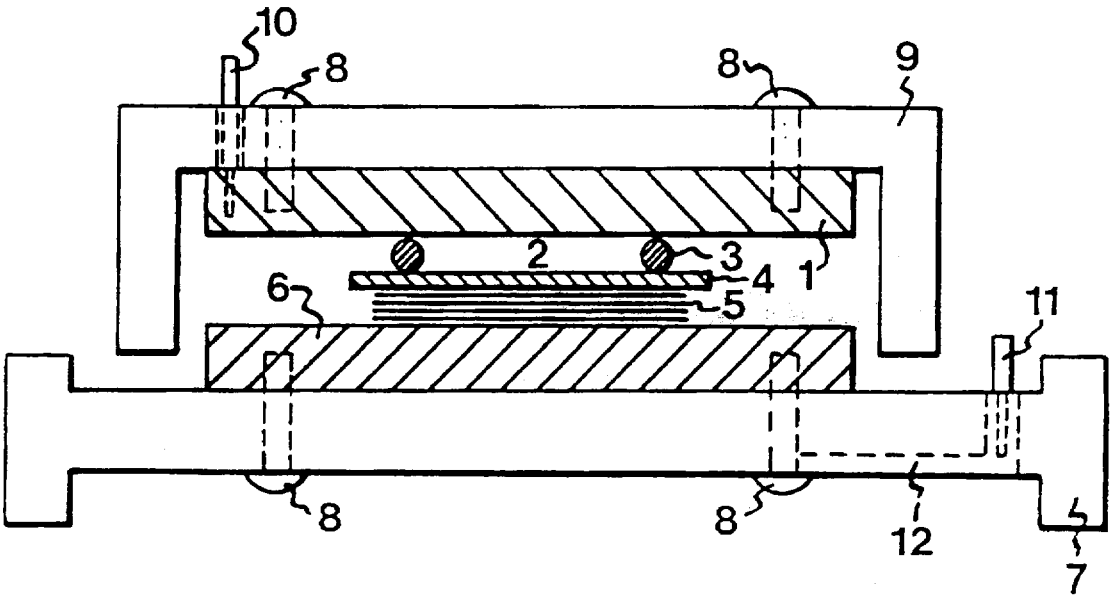
Figure 2:
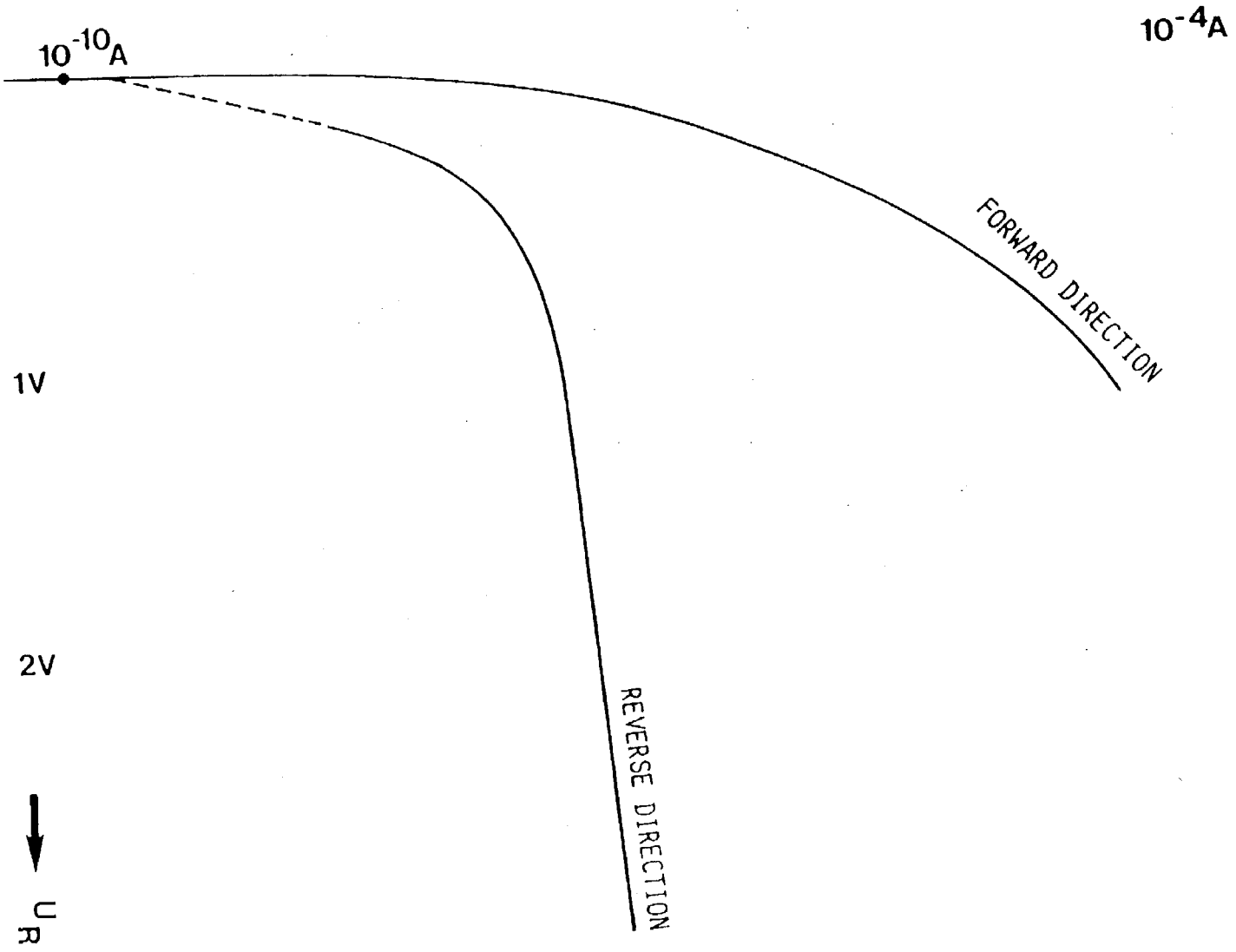
Figure 3:
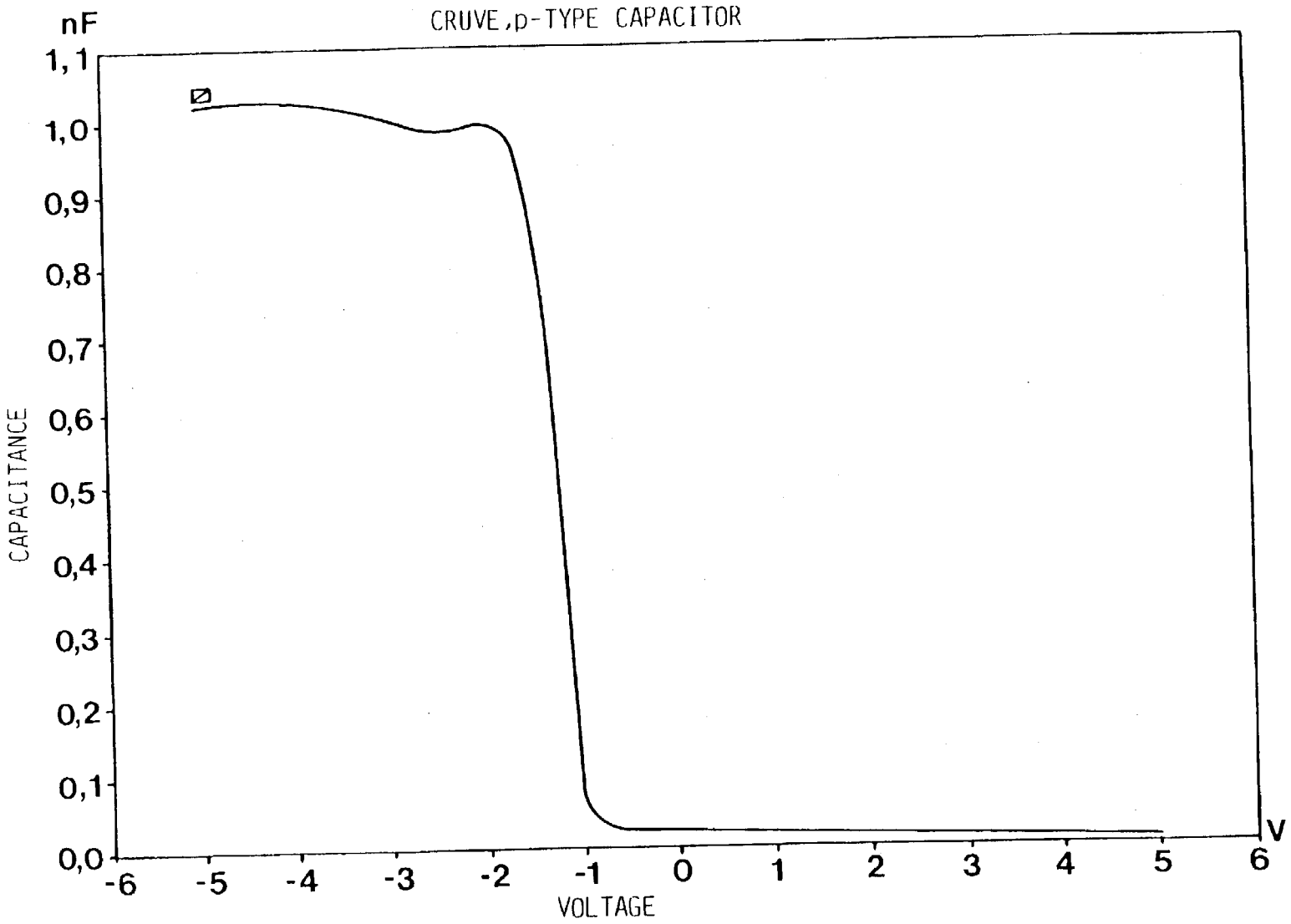

The invention will be described in more detail hereinbelow with reference to the accompanying drawings, in which FIG. 1 shows a preferred device according to the invention partly in section, and FIGS. 2 and 3 show the characteristics of a silicon oxide wafer obtained by means of the invention.

Between a cathode 1 and an anode 6 is provided a silicon wafer 4 (of which only the cathode-facing surface is to be oxidised). The components cathode, anode and silicon wafer are horizontally arranged. The cathode compartment 2 is defined by a silicon strand 3 shaped into a circle and disposed between and in direct engagement with the cathode and the silicon wafer. A similar arrangement may be used on the anode side as well, but in this Example it is preferred to use as anode-medium carrier a package of circular filter-paper sheets 5. The electrodes 1 and 6 are fixed on metallic holders 9 and 7, respectively, by bolts 8 and are essentially larger than the silicon wafer 4. Moreover, the cathode 1 and its holder 9 have a considerable weight, so that the assembly is able to compress the components 1, 3, 4, 5 and 6 into good physical and electrical contact with each other. The cathode and the anode terminals to a direct-current source (not shown) are designated 10 and 11. Here, the anode terminal 11 is shown to have a connection 12 with the bolt 8.

EXAMPLE

In the following Example, the parameters in anode oxidation of silicon wafers were the following, unless otherwise indicated. Electrode gap: 25 mm; starting voltage: 30 V; oxidation time: 10 min; electrolyte in both cathode and anode compartments: - 50 mM sodium phosphate - 2.1715 g of $Na_2HPO_4$+0.9358 g of $NaH_2PO_4$ in 400 ml of distilled water - at a pH of 7.0.

The electrodes consisted of 170×175×5 mm graphite plates, and the cathode 1 with its holder weighed 1.5 kg (the weight of the cathode being 0.73 kg). The silicon wafer was a 3-inch circular disc having a thickness of 330 μm and a conductivity of 10 Ω.

The temperature was room temperature (20°–25° C.). The filter paper used was Munktell No. 3, A 3-90-700 circular discs of 1.75-inch diameter. The silicon strand was 4 mm in diameter and was formed into a circle having a diameter of 30 mm.

The silicon oxide thickness was measured by means of an ellipsometer, AutoEl III, Rudolph Research Inc., N.J.

Examples 1–4, Ionic Strength

Anode oxidation was conducted with the aforementioned electrolyte at ionic strengths 25; 50; 100; and 200 mM. Current intensity was 40 mA. The thickness of the silicon oxide layers measured was 354; 332; 291 and 279 Å, respectively, with a spread of ±1.5; 1.8; 2.0; and 8.0, respectively. Example 4 did not satisfy the preferred quality requirement, and higher ionic strengths yield thinner oxide layers and a greater spread.

Examples 5–9, pH

Anode oxidation was conducted with the aforementioned electrolyte, however at pH values 1.9; 4.5; 7.0; 9.0; and 11.6. Current intensity was 40 mA. The silicon oxide thickness measured was 120; 371; 332; 296 and 222 222 Å, respectively, with a maximum spread of ±10.5; 1.5; 0.9; 2.0 and 15.0 Å, respectively, where the first and the last values do not satisfy the preferred quality requirement.

Examples 10–14, Current Intensity

Anode oxidation was conducted at current intensities 10; 20; 40; 60 and 80 mA. The voltage range was 28–65 V. The silicon oxide thickness measured was 79; 155; 319; 473 and 615 Å, respectively. In all these tests, the maximum spread was ±5 Å. The measured values indicate a linear relationship. The first two results do not satisfy the preferred quality requirement.

Examples 15–18, Gap

Anode oxidation was conducted using a gap between the electrodes 1 and 6 of 6; 25; 50 and 100 mm, this variation in electrode gap being achieved by means of a silicon strand and a spacer annulus provided between the cathode and the silicon wafer. Current intensity was 10 mA. Approximately the same oxide layer thickness of 100–110 Å was obtained for all gaps, and the maximum thickness variation was ±5 Å.

Example 19, Electrolyte

Anode oxidation was conducted using Tris as electrolyte. Quite similar results as in Examples 1–18 above were obtained, i.e. the silicon oxide thickness and the spread fell within the preferred range.

FIG. 2 shows a current-voltage characteristic and FIG. 3 a capacitance-voltage characteristic for a silicon oxide wafer produced by means of the above-mentioned device and having an oxide thickness of 350 Å. The characteristics were determined over different points on the silicon oxide wafer, the illustrated characteristics being representative of the series obtained, i.e. the oxide thickness was substantially constant across the wafer. The breakdown voltage was much above 10 V, and the current in the reverse direction at room temperature was about $10^{-6}$A at 10 V. The CV curve was measured at 1 mHz; the flat band voltage was determined at −0.91 V. Other parameters: bulk doping $2.9\times10^{12}$ $cm^3$, oxide capacitance 1029 pF, oxide charge (fixed, traps, mobile) $3.6\times10^{11}$ cm.

We claim:

1. A device, which device comprises: a plate anode and a plate cathode as well as an arrangement enclosing electrolyte and holding a silicon wafer between and spaced from said anode and cathode, characterised in that:

(a) the anode and the cathode, both arranged horizontally and adapted to hold the silicon wafer horizontally there between, (b) the anode and the cathode are larger than the silicon wafer, when said wafer is present, (c) the holder arrangement consists of loose spacers provided between the silicon wafer, when said wafer is present, and the respective electrodes, (d) said spacers adapted to enclose the electrolyte when between the respective electrodes and said wafer when said wafer is in place, and (e) the electrodes and spacers being adapted to be held together only by gravity in a stack with said silicon wafter when said wafer is present.

2. The device in claim 1, where the upper spacer is formed by an annulus of inert material.

3. The device in claim 1, where the lower spacer is formed by one or more layers of porous material.

* * * * *